US006814043B2

(12) United States Patent
Harima et al.

(10) Patent No.: US 6,814,043 B2
(45) Date of Patent: Nov. 9, 2004

(54) STRUCTURE OF BEARING HOUSING OF CYLINDER BLOCK

(75) Inventors: Kenji Harima, Tokyo (JP); Akihiro Katsuya, Kanagawa (JP); Tohru Shiraishi, Kanagawa (JP)

(73) Assignees: Fuji Jukogyo Kabushiki Kaisha, Tokyo (JP); NHK Spring Co., Ltd., Yokohama (JP)

( * ) Notice: Subject to any disclaimer, the term of this patent is extended or adjusted under 35 U.S.C. 154(b) by 18 days.

(21) Appl. No.: 10/638,971

(22) Filed: Aug. 11, 2003

(65) Prior Publication Data

US 2004/0123829 A1 Jul. 1, 2004

Related U.S. Application Data

(62) Division of application No. 10/058,697, filed on Jan. 28, 2002, now Pat. No. 6,647,945.

(30) Foreign Application Priority Data

Jan. 31, 2001 (JP) ..... 2001-23166

(51) Int. Cl.[7] ..... F02F 7/00
(52) U.S. Cl. ..... 123/195 R

(58) Field of Search ..... 123/195 R, 195 H, 123/195 C, 195 S, 197.4, 197.3, 195 A, 197.2

(56) References Cited

U.S. PATENT DOCUMENTS 4,438,738 A * 3/1984 Kosuda et al. ..... 123/90.39
4,908,923 A * 3/1990 Anderson et al. ..... 29/888.01
5,800,902 A * 9/1998 Shimmell et al. ..... 428/139

FOREIGN PATENT DOCUMENTS

DE 3911822 A1 * 10/1990 ..... F01B/31/00
EP 1403498 A1 * 3/2004 ..... B22D/19/00

* cited by examiner

*Primary Examiner*—Tony M. Argenbright
*Assistant Examiner*—Hyder Ali

(57) ABSTRACT

A structure of bearing housings of a cylinder block comprises aluminum alloy for constituting the whole cylinder block and a plurality of fiber reinforced metal (FRM) areas. The FRM areas are formed by integrally casting a sheet-like preform containing reinforced metal fibers with aluminum alloy. A plurality of such sheet-like preforms are separately provided in a bearing housing in an axial direction of a crankshaft.

1 Claim, 3 Drawing Sheets

STRUCTURE OF BEARING HOUSING OF CYLINDER BLOCK

This application is a divisional application of U.S. patent application Ser. No. 10/058,697, filed Jan. 28, 2002, now U.S. Pat. No. 6,647,945, which claims priority of Japanese Application No. 2001-23166, filed Jan. 31, 2001, which is incorporated herein by reference in its entirety.

BACKGROUND OF THE INVENTION

1. Field of the Invention

The present invention relates to a structure of a bearing housing of a cylinder block of an internal combustion engine and more particularly to a bearing housing formed by material having a thermal expansion coefficient different from that of a crankshaft.

2. Description of Background Arts

There is an engine whose cylinder block is cast in aluminum alloy to reduce the weight of the engine. A plurality of bearing housings provided in the cylinder block and an iron-made crankshaft is supported at crank journals thereof by the bearing housings through metal bearings. When the engine is operative, heat produced by combustion of mixture gas is transmitted to the bearing beds of the cylinder block. As a result, the temperature of the bearing housings increases to expand clearances between the aluminum alloy made bearing housings and the crank journals, this causing noises and vibrations from the engine.

Japanese Patent Application Laid-open No. Toku-Kai-Hei 10-159648 discloses a technique in which light weight aluminum alloy made bearing caps having a low thermal expansion coefficient and high rigidity are joined by supersonic soldering to the bearing housings. Also, the patent application discloses an embodiment of a bearing cap made of fiber reinforced aluminum alloy. The bearing cap has the same width as that of the bearing housings and a bearing cap is jointed to the respective bearing housings.

According to the prior art, since the bearing cap is made of aluminum alloy having a low coefficient of thermal expansion, the difference between a coefficient of thermal expansion of the bearing housings and that of the crank journals can be reduced. Therefore, since the clearance between the crankshaft and the bearing surface is kept in an appropriate level irrespective of temperature changes, the problem of vibrations and noises can be solved.

Further, Japanese Patent Application Laid-open No. Toku-Kai 2000-205037 discloses a technique wherein a bulkhead for connecting left and right walls of a cylinder block and for supporting a bearing housing has a fiber reinforced preform integrally cast almost over the full length in a transverse direction between the left and right walls of the cylinder block and accordingly a fiber reinforced metal (FRM) area is formed around a part where the preform is integrally cast. As a result, the bulkhead having high rigidity damps vibrations of the left and right walls and at the same time prevents thermal expansion of the bearing surfaces.

The bearing housing is required to have adequate strength and rigidity because impact loads caused by the combustion of air-fuel mixture is directly applied to the bearing housing. The method of integrally casting a piece of large preform laterally extending over the full length of the bulkhead between the left and right outer walls of the cylinder block as described in Toku-Kai 2000-205037 has a disadvantage that since the preform itself has a large volume and molten aluminum inadequately impregnates into the preform, sometimes cavities are produced in the preform. The bearing housings containing cavities therein have large dispersions in thermal expansion coefficients and provide inadequate strength and rigidity. On the other hand, in case where the volume of the preform is decreased in order to avoid such inconvenience, it becomes difficult to attain an original object of properly controlling the clearance between the crank journals and bearing surfaces.

SUMMARY OF THE INVENTION

It is an object of the present invention to provide bearing housings having high strength and rigidity and capable of reducing the difference of thermal expansion coefficients between bearing housings (bearing surfaces) and crank journals.

To achieve the object, the structure of bearing housings comprises aluminum alloy for constituting a whole cylinder block and a plurality of fiber reinforced metal areas containing reinforced metal fibers integrally cast with aluminum alloy separately in an axial direction of a crankshaft.

DESCRIPTION OF THE PREFERRED EMBODIMENT

Figure 1:
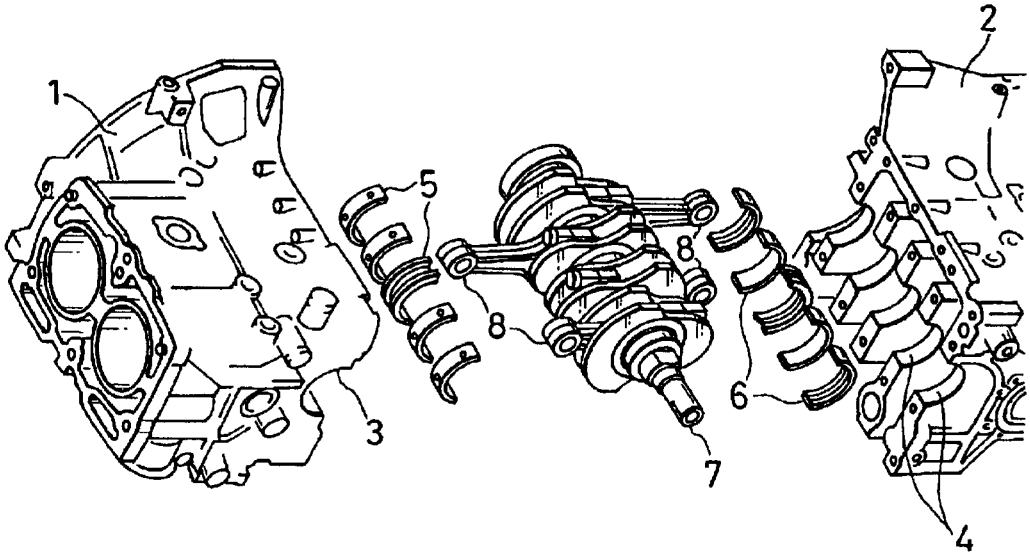
FIG. 1 is an exploded perspective view of a horizontally opposed four cylinders engine.

Referring now to FIG. 1, reference numerals 1, 2 denote left and right cylinder blocks respectively. These left and right cylinder blocks 1, 2 are independently cast in aluminum alloy having a thermal expansion coefficient of $21.0\times10^{-6}/°$ C. for example. The left cylinder block 1 has a plurality of left bearing housings 3 shaped into semi circular grooves. Similarly, the right cylinder block has a plurality of right bearing housings 4 shaped into semicircular grooves. There are provided left and right bearing metals 5, 6 in these left and right semicircular bearing housings 3, 4 respectively. That is, a crankshaft 7 is rotatably supported by bearing surfaces formed by the left and right bearing metals 5, 6. For example, the crankshaft 7 is formed by steal containing 0.5% carbon (thermal expansion coefficient: $12.0\times10^{-6}/°$ C.). When air-fuel mixture gas burns in cylinders, pistons make reciprocating movement. The reciprocating movement is converted into rotating movement by connecting rods 8 and the rotating force rotates the crankshaft 7. The bearing housings 3, 4 are subjected to large impact loads constantly and at the same time thermally expand.

Figure 2:
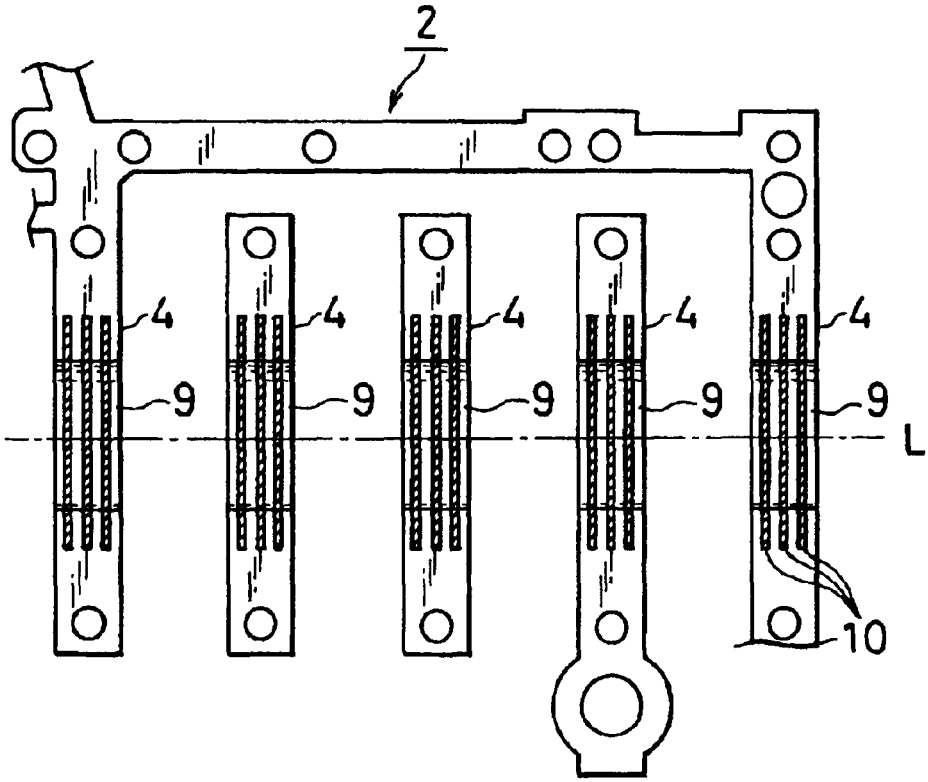
FIG. 2 is a top view of bearing housings of a cylinder block according to an embodiment of the present invention.

Referring to FIG. 2, five bearing bosses 4 are provided in a perpendicular direction to a centerline L of the crankshaft 7 and a centerline of semicircular bearing surfaces 9 agrees with the centerline L. Further, three FRM areas 10 are arranged in a perpendicular direction to the centerline L in parallel with each other. The FRM areas 10 contain reinforced fibers with high strength. That is, the FRM areas 10 are ones where reinforced fibers are integrally compounded with aluminum alloy or ones that are fiber-reinforced-metallized. According to the present embodiment, for example, reinforced fibers are formed by filaments having a wire diameter of around 0.1 millimeters and made of heat resistant steel (Fe—Cr—Si) having a thermal expansion coefficient of $11.6\times10^{-6}/°$ C. Other example of reinforced fibers are filaments made of heat resistant steel (Fe—Mn—Si) having a thermal expansion coefficient of $8.8\times10^{-6}/°$ C.

Adjacent FRM areas 10 have non fiber-reinforced-metallized aluminum alloy in between. Further, the respective FRM areas 10 have a plate-shaped configuration having the same plate width W1. Further, the FRM areas 10 can be seen from the top side of the bearing housing 4 but can not seen from the axial side of the crankshaft 7. That is, the FRM areas 10 are completely buried in base material, aluminum alloy except the edge on the top side thereof. Thus, since molten aluminum impregnates from both sides of the FRM areas 10, voids can be effectively prevented from being generated.

Such multi-layer structure of the bearing bosses 3, 4 are obtained by integrally casting a block of fine line filaments or a preform molded into a plate having a specified configuration with the bearing bosses 3, 4. Specifically, first, a sheet-like preform having a depth W1 and containing a specified percentage of voids is molded from a block of woolly metal filaments (reinforced fibers). The percentage of voids is a volumetric percentage of voids (noncharged parts) per unit volume. Since the preform is fiber-reinforced-metallized by impregnate molten aluminum into these voids, the percentage of voids is one of most important elements to determine strength, rigidity and thermal expansion coefficient of the metallized preform. Accordingly, a preform having a specified percentage of voids is formed by appropriately controlling a degree of compression of the woolly metal filaments. Beside the percentage of voids, material of metal filaments, a diameter of wire, a sheet weight, a sheet configuration, a number of sheets to be cast, an interval between sheets and the like, are important and in view of a required specification of the bearing housings 4, these elements should be also taken into consideration.

Figure 3:
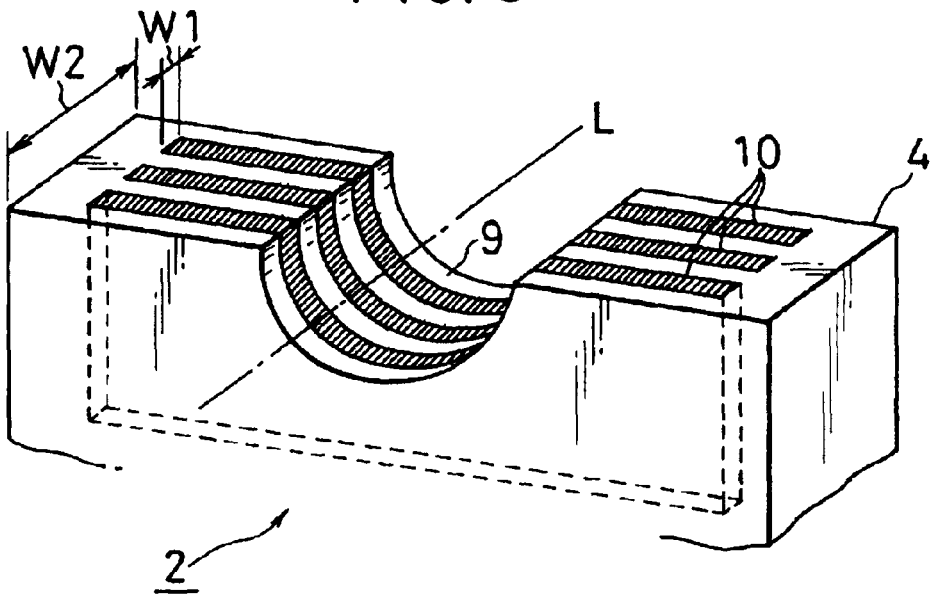
FIG. 3 is an enlarged perspective view of a bearing housing.
Figure 4:
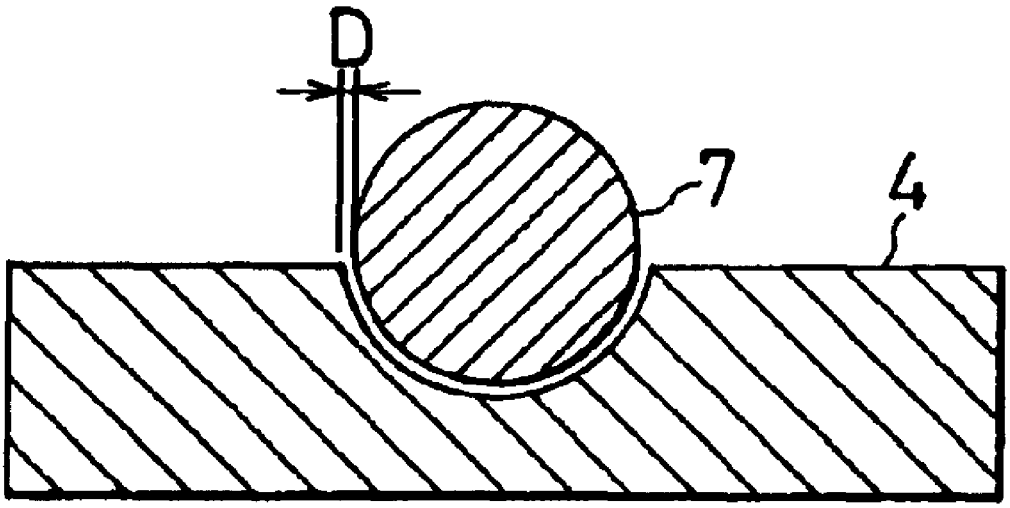
FIG. 4 is an explanatory view of a clearance a crank journal and a bearing housing.

Next, the sheet-like preform is arranged at an equal interval at the correct position where a bearing housing 4 is to be located and then the cylinder block 2 is integrally cast with the preform. When the preform is integrally cast, molten aluminum impregnates into voids in the preform and the preform is fiber-reinforced-metallized and an independent FRM 10 is formed. Since a plurality of preforms are integrally cast, as shown in FIG. 3, the thickness W1 of a sheet of preform can be made thin compared to the width W2 of the bearing housing 4. As a result, the volume of an individual preform can be reduced and molten aluminum adequately impregnates inside of the preform. Accordingly, a FRM area 10 having no voids wherein aluminum alloy is strongly combined with reinforced fibers is formed.

In case where the configuration of the bearing housing 4 is complicated, the preform may be buried at an inequal interval in order to control thermal expansion of the bearing housing 4.

Thus, according to the embodiment of the present invention, the structure of the bearing housing of the cylinder block 1, 2 enables to properly control thermal expansion coefficients of the bearing housings 3, 4 and to secure strength and rigidity there of. That is, the multi-layer structure of aluminum alloy and the fiber reinforced metal area 10 produces an intermediate thermal expansion coefficient between those of aluminum alloy and reinforced fiber. Such intermediate thermal expansion coefficient enables to reduce the difference of thermal expansion coefficients between the crankshaft 7 and the bearing housings 3, 4. As a result, the clearance D between the bearing housings 3, 4 and the crankshaft 7 is prevented from being changed under high temperature conditions and vibrations and noises generated from the engine can be reduced.

Particularly, since a plurality of FRM areas 10 are formed separately in the respective bearing housings 3, 4, boundary areas between aluminum alloy and the fiber reinforced metal area can be enlarged and consequently boundary areas between reinforced fiber and matrix metal can also be enlarged. As a result, the strength of an entire bearing bed increases. Further, since the respective FRM areas 10 join aluminum alloy except for bearing surfaces, an adequate joining strength providing strength, rigidity and appropriate clearance control can be secured.

Further, since a plurality of FRM areas 10 are provided separately, the volume of an individual FRM area 10 can be reduced. As a result, voids can be almost eliminated from the fiber reinforced metal area 10, accordingly required strength and rigidity can be ensured and dispersions of thermal expansion coefficients between products of bearing housings can be minimized.

In the aforesaid embodiment, an horizontally opposed engine has been exemplified, however the structure of the bearing housing can be applied to other types of engines, in-line engines, V-type engines and the like.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments which can be embodied without departing from the principle of the invention set out in the appended claims.

What is claimed is:

1. A structure of a cylinder block of an internal combustion engine for supporting a crankshaft made of iron, and having a bearing housing made of aluminum alloy with a thermal expansion coefficient different from that of a crankshaft, comprising:

a plurality of fiber reinforced metal areas containing reinforced metal fibers separately buried in said bearing housing of said cylinder block, said reinforced metal fibers being made of material mainly containing Fe—Cr or Fe—Mn, wherein said respective fiber reinforced metal areas are arranged apart from each other perpendicularly to an axial direction of said crankshaft.

* * * * *